US010774574B2

(12) United States Patent
Lamm

(10) Patent No.: US 10,774,574 B2
(45) Date of Patent: Sep. 15, 2020

(54) OPERATION OF VEHICLE POWER DOORS

(71) Applicant: Honda Motor Co., Ltd., Tokyo (JP)

(72) Inventor: Kevin Lamm, Pataskala, OH (US)

(73) Assignee: Honda Motor Co., Ltd., Tokyo (JP)

( * ) Notice: Subject to any disclaimer, the term of this patent is extended or adjusted under 35 U.S.C. 154(b) by 215 days.

(21) Appl. No.: 15/935,084

(22) Filed: Mar. 26, 2018

(65) Prior Publication Data

US 2019/0292833 A1 Sep. 26, 2019

(51) Int. Cl.
*E05F 15/70* (2015.01)

(52) U.S. Cl.
CPC ..... *E05F 15/70* (2015.01); *E05Y 2400/36* (2013.01); *E05Y 2400/40* (2013.01); *E05Y 2400/44* (2013.01); *E05Y 2400/53* (2013.01); *E05Y 2900/531* (2013.01); *E05Y 2900/546* (2013.01)

(58) Field of Classification Search
None
See application file for complete search history.

(56) References Cited

U.S. PATENT DOCUMENTS

| | | | | |
|---|---|---|---|---|
| 6,289,735 | B1 | 9/2001 | Dister et al. | |
| 6,719,356 | B2 | 4/2004 | Cleland et al. | |
| 6,904,717 | B2 | 6/2005 | Clark et al. | |
| 7,070,226 | B2 * | 7/2006 | Cleland | E05F 1/1091 296/146.8 |
| 7,212,897 | B2 | 5/2007 | Suzuki et al. | |
| 7,423,400 | B2 | 9/2008 | Chinsen et al. | |
| 7,592,762 | B2 * | 9/2009 | Warren | E05F 15/611 318/266 |
| 8,027,769 | B2 | 9/2011 | Oualkadi et al. | |
| 8,065,060 | B2 | 11/2011 | Danko | |
| 8,068,958 | B2 | 11/2011 | Schlesiger et al. | |
| 8,428,828 | B2 | 4/2013 | Serban et al. | |
| 9,528,629 | B2 | 12/2016 | Anderson et al. | |
| 9,879,463 | B2 * | 1/2018 | Lombrozo | E05B 79/20 |
| 10,000,961 | B2 * | 6/2018 | Elie | E05F 15/40 |
| 10,151,132 | B2 * | 12/2018 | Elie | E05F 15/60 |
| 10,180,025 | B2 * | 1/2019 | Conner | E05F 15/622 |
| 10,443,287 | B2 * | 10/2019 | Elie | G01D 5/26 |
| 2006/0181108 | A1 | 8/2006 | Cleland et al. | |

(Continued)

FOREIGN PATENT DOCUMENTS

| | | |
|---|---|---|
| EP | 1970516 | 9/2008 |
| EP | 1970520 | 9/2008 |
| WO | 2007071868 | 6/2007 |

*Primary Examiner* — Catherine A Kelly
(74) *Attorney, Agent, or Firm* — Rankin, Hill & Clark LLP

(57) ABSTRACT

According to one aspect, vehicle power door operation is described herein. A first accelerometer may be mounted to a first portion of a vehicle and a second accelerometer may be mounted to a second portion of the vehicle. A motor controller may control a power operation of a door of the vehicle. An electronic control unit (ECU) may receive a first measurement from the first accelerometer, receive a second measurement from the second accelerometer, determine an orientation of the vehicle relative to a reference plane based on the first measurement and the second measurement, determine any movement of the vehicle relative to the reference plane based on the first measurement and the second measurement, and adjust the power operation of the power door by the motor controller based on the determined orientation and the determined movement.

20 Claims, 9 Drawing Sheets

(56) References Cited

U.S. PATENT DOCUMENTS

| | | | | |
|---|---|---|---|---|
| 2014/0111356 | A1 | 4/2014 | LeFebvre et al. | |
| 2017/0030128 | A1 | 2/2017 | Elie et al. | |
| 2018/0363353 | A1* | 12/2018 | Ghannam | E05F 15/60 |
| 2019/0112849 | A1* | 4/2019 | Cumbo | E05F 15/611 |

* cited by examiner

OPERATION OF VEHICLE POWER DOORS

BACKGROUND

Vehicle closure systems may use a Hall Effect sensor mounted to a vehicle and associated outputs of the Hall Effect sensor to control a drive motor closing a door of the vehicle. In this regard, the Hall Effect sensor may be utilized to determine a speed or position of the door relative to a position of a body of the vehicle. However, Hall Effect sensors may be associated with drift and thus, require compensation. Further, if power is lost during the door closing operation, recalibration of the Hall Effect sensor may be required.

BRIEF DESCRIPTION

According to one aspect, a system for vehicle power door operation may include a first accelerometer, a second accelerometer, a motor controller, and an electronic control unit (ECU). The first accelerometer may be mounted to a first portion of a vehicle. The second accelerometer may be mounted to a second portion of the vehicle. The motor controller may control a power operation of a door of the vehicle. The ECU may receive a first measurement from the first accelerometer, receive a second measurement from the second accelerometer, determine an orientation of the vehicle relative to a reference plane based on the first measurement and the second measurement, and adjust the power operation of the power door by the motor controller based on the determined orientation.

The first measurement or the second measurement may include a proper acceleration measurement or a coordinate acceleration measurement. The first accelerometer may be mounted to a vehicle body of the vehicle, the second accelerometer may be mounted to a power door of the vehicle, and the motor controller may control a power operation of the power door of the vehicle. The first accelerometer may be integrated with the ECU. The first accelerometer and the second accelerometer may be 2-axis or 3-axis accelerometers. Adjusting the power operation of the power door by the motor controller may include reversing a direction of the power operation of the power door or stopping operation of the power door. The system may include a bus operably connecting the first accelerometer, the second accelerometer, the motor controller, and the ECU. The ECU may determine any movement of the vehicle relative to the reference plane based on the first measurement and the second measurement and adjust the power operation of the power door by the motor controller based on the determined movement.

According to one aspect, a system for vehicle power door operation may include a first accelerometer, a second accelerometer, a motor controller, and an electronic control unit (ECU). The first accelerometer may be mounted to a first portion of a vehicle. The second accelerometer may be mounted to a second portion of the vehicle. The motor controller may control a power operation of a door of the vehicle. The ECU may receive a first measurement from the first accelerometer, receive a second measurement from the second accelerometer, determine any movement of the vehicle relative to a reference plane based on the first measurement and the second measurement, and adjust the power operation of the power door by the motor controller based on the determined movement.

The first measurement or the second measurement may include a proper acceleration measurement or a coordinate acceleration measurement. The first accelerometer may be mounted to a vehicle body of the vehicle, the second accelerometer may be mounted to a power door of the vehicle, and the motor controller may control a power operation of the power door of the vehicle. The first accelerometer may be integrated with the ECU. The first accelerometer and the second accelerometer may be 2-axis or 3-axis accelerometers. Adjusting the power operation of the power door by the motor controller may include reversing a direction of the power operation of the power door or stopping operation of the power door. The system may include a bus operably connecting the first accelerometer, the second accelerometer, the motor controller, and the ECU. The ECU may determine an orientation of the vehicle relative to the reference plane based on the first measurement and the second measurement and adjust the power operation of the power door by the motor controller based on the determined orientation.

According to one aspect, a system for vehicle power door operation may include a first accelerometer, a second accelerometer, a motor controller, and an electronic control unit (ECU). The first accelerometer may be mounted to a first portion of a vehicle. The second accelerometer may be mounted to a second portion of the vehicle. The motor controller may control a power operation of a door of the vehicle. The ECU may receive a first measurement from the first accelerometer, receive a second measurement from the second accelerometer, determine an orientation of the vehicle relative to a reference plane based on the first measurement and the second measurement, determine any movement of the vehicle relative to the reference plane based on the first measurement and the second measurement, and adjust the power operation of the power door by the motor controller based on the determined orientation and the determined movement.

The first measurement or the second measurement may include a proper acceleration measurement or a coordinate acceleration measurement. The first accelerometer may be mounted to a vehicle body of the vehicle, the second accelerometer may be mounted to a power door of the vehicle, and the motor controller may control a power operation of the power door of the vehicle. The first accelerometer and the second accelerometer may be 2-axis or 3-axis accelerometers.

DETAILED DESCRIPTION

Figure 1:
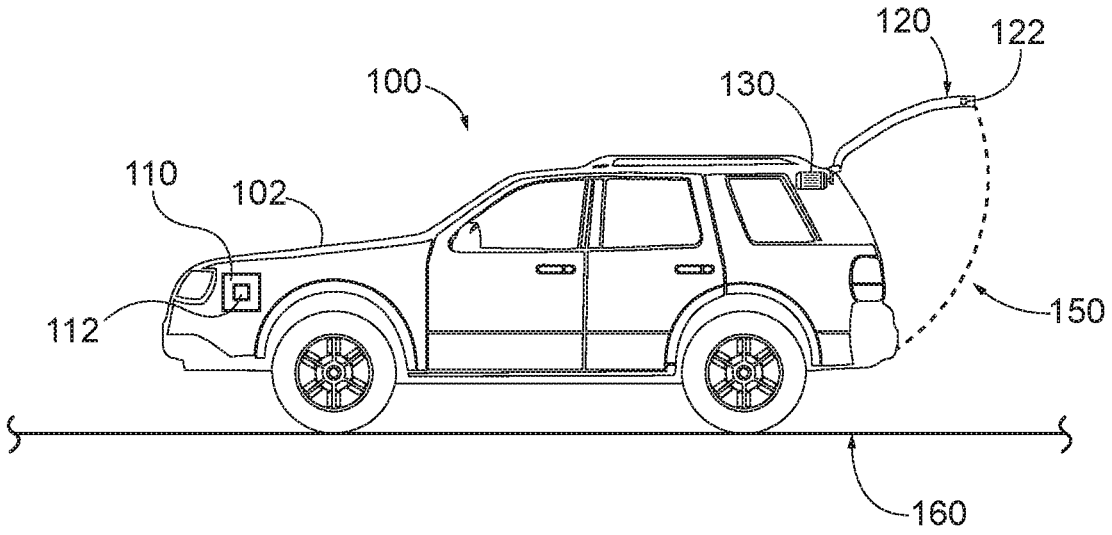
FIG. 1 is an illustration of an exemplary system for vehicle power door operation, according to one aspect.

The following terms are used throughout the disclosure, the definitions of which are provided herein to assist in understanding one or more aspects of the disclosure.

"Vehicle", as used herein, refers to any moving vehicle that is capable of carrying one or more human occupants and is powered by any form of energy. In some cases, a motor vehicle includes one or more engines. The term "vehicle" may also refer to an autonomous vehicle and/or self-driving vehicle powered by any form of energy. The vehicle may carry one or more human occupants or other cargo. Further, the term "vehicle" may include vehicles that are automated or non-automated with pre-determined paths or free-moving vehicles.

"Module", as used herein, includes, but is not limited to, a non-transitory computer readable medium that stores instructions, instructions in execution on a machine, hardware, firmware, software in execution on a machine, and/or combinations of each to perform a function(s) or an action(s), and/or to cause a function or action from another module, method, and/or system. A module may include logic, a software controlled microprocessor, a discrete logic circuit, an analog circuit, a digital circuit, a programmed logic device, a memory device containing executing or executable instructions, logic gates, a combination of gates, and/or other circuit components, such as the modules, systems, devices, units, or any of the components of FIG. 1. Multiple modules may be combined into one module and single modules may be distributed among multiple modules.

"Bus", as used herein, refers to an interconnected architecture that is operably connected to other computer components inside a computer or between computers. The bus may transfer data between the computer components. The bus may be a memory bus, a memory processor, a peripheral bus, an external bus, a crossbar switch, and/or a local bus, among others. The bus may also be a vehicle bus that interconnects components inside a vehicle using protocols such as Media Oriented Systems Transport (MOST), Controller Area Network (CAN), Local Interconnect network (LIN), among others.

"Communication", as used herein, refers to a communication between two or more computing devices (e.g., computer, personal digital assistant, cellular telephone, network device) and/or components and may be, for example, a network transfer, a file transfer, an applet transfer, an email, a hypertext transfer protocol (HTTP) transfer, and so on. A computer communication may occur across, for example, a wireless system (e.g., IEEE 802.11), an Ethernet system (e.g., IEEE 802.3), a token ring system (e.g., IEEE 802.5), a local area network (LAN), a wide area network (WAN), a point-to-point system, a circuit switching system, a packet switching system, among others.

"Operable connection", as used herein, or a connection by which entities are "operably connected", is one in which signals, physical communications, and/or logical communications may be sent and/or received. An operable connection may include a wireless interface, a physical interface, a data interface, and/or an electrical interface. For example, one or more of the components of FIG. 1 may be operably connected with one another, thereby facilitating communication therebetween.

"Infer" or "inference", as used herein, generally refers to the process of reasoning about or inferring states of a system, a component, an environment, a user from one or more observations captured via events or data, etc. Inference may be employed to identify a context or an action or may be employed to generate a probability distribution over states, for example. An inference may be probabilistic. For example, computation of a probability distribution over states of interest based on a consideration of data or events. Inference may also refer to techniques employed for composing higher-level events from a set of events or data. Such inference may result in the construction of new events or new actions from a set of observed events or stored event data, whether or not the events are correlated in close temporal proximity, and whether the events and data come from one or several event and data sources.

FIG. 1 is an illustration of an exemplary system 100 for vehicle power door operation, according to one aspect. The system 100 for vehicle power door operation may be implemented on a vehicle to facilitate anti-entrapment for one or more doors of the vehicle during vehicle power door operations, such as power opening or power closing of respective doors. As used herein, a door (e.g., power door) is used interchangeably with a tailgate, a power tailgate 120, or a power trunk. In other words, although some examples may be described with reference to a power door or the power tailgate 120, it is understood that these embodiments may be implemented with respect to either. Additionally, the system 100 for vehicle power door operation may provide adjustments during vehicle power door operations.

According to one aspect, the system 100 for vehicle power door operation may include an electronic control unit (ECU) 110 which includes a first accelerometer 112. Stated another way, according to this aspect, the first accelerometer 112 may be integrated with the ECU 110. It will be appreciated that, according to other aspects, the first accelerometer 112 may be mounted at other locations or positions on a vehicle body 102 of the vehicle. In any event, in FIG. 1, the power tailgate 120 of the vehicle may have a second accelerometer 122 mounted thereto. A motor controller 130 may be utilized to open and close the power tailgate 120. As a result of the opening and closing of the power tailgate 120, the second accelerometer 122 may travel along a path 150. In FIG. 1, the path 150 of the second accelerometer 122 is generally downwards, in the same direction as gravity, but in other scenarios, such as the scenario as will be described with reference to FIG. 3 herein, the path 150 of the second accelerometer 122 may include an upward portion or component, in the opposite direction as gravity.

The first accelerometer 112 and the second accelerometer 122 may be 2-axis, multi-axis accelerometers, or 3-axis accelerometers which detect a magnitude and a direction of acceleration. In this regard, the first accelerometer 112 and the second accelerometer 122 may provide measurements as proper acceleration or as coordinate acceleration. The first accelerometer 112 may be mounted to a first portion of the vehicle while the second accelerometer 122 may be mounted to a second portion of the vehicle. The first accelerometer 112 may provide a first measurement to the ECU 110 and the second accelerometer 122 may provide a second measurement to the ECU 110. These first and second measurements may include a proper acceleration measurement or a coordinate acceleration measurement, measurements relating to an orientation of the corresponding accelerometer with respect to gravity, movement associated with the corresponding accelerometer, etc.

Using these first and second measurements, the ECU 110 may calculate a position, an orientation, a velocity, an angle associated with the power tailgate 120 opening with respect to gravity, or other movement of the vehicle without any other external references. In other words, using the first and second measurements from the first accelerometer 112 and the second accelerometer 122, respectively, the ECU 110 may determine (e.g., via a comparison of the first and second measurements) an orientation of the vehicle relative to a reference plane 160 or any movement associated with the vehicle relative to the reference plane 160. Stated yet another way, the ECU 110 may determine the orientation of the vehicle relative to the reference plane 160 based on the first measurement and the second measurement (as will be described with reference to FIGS. 3-4) and determine any (e.g., associated) movement of the vehicle (as will be described with reference to FIG. 5) relative to the reference plane 160 based on the first measurement and the second measurement (e.g., via the comparison of respective measurements).

Figure 2:
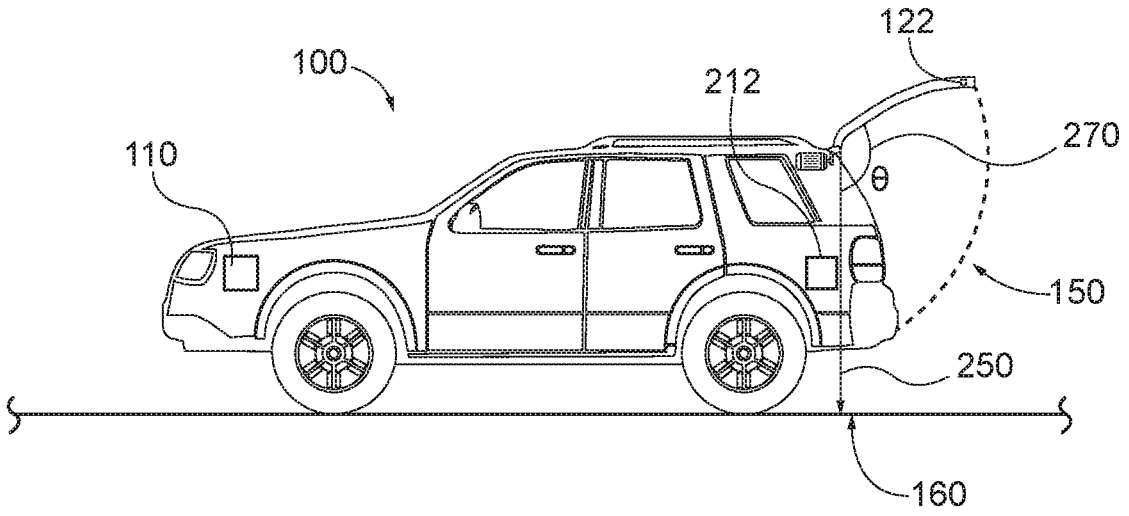
FIG. 2 is an illustration of an exemplary system for vehicle power door operation, according to one aspect.

FIG. 2 is an illustration of an exemplary system 100 for vehicle power door operation, according to one aspect. In FIG. 2, a third accelerometer 212 may be mounted to a third portion of the vehicle (e.g., a rear portion of the vehicle body 102). Similarly to the first accelerometer 112 and the second accelerometer 122, the third accelerometer 212 may also provide a measurement of proper acceleration or coordinate acceleration. Because the vehicle is parked on a flat ground plane, the third accelerometer 212 may register a reading of 9.81 $m/s^2$ while the vehicle is at rest, due to the Earth's gravity (e.g., which may be used as another reference plane 250), for example. Additionally, these measurements, the ECU 110 may calculate an angle 270 associated with the power tailgate 120 opening with respect to gravity 250 (without using any external references).

Figure 3:
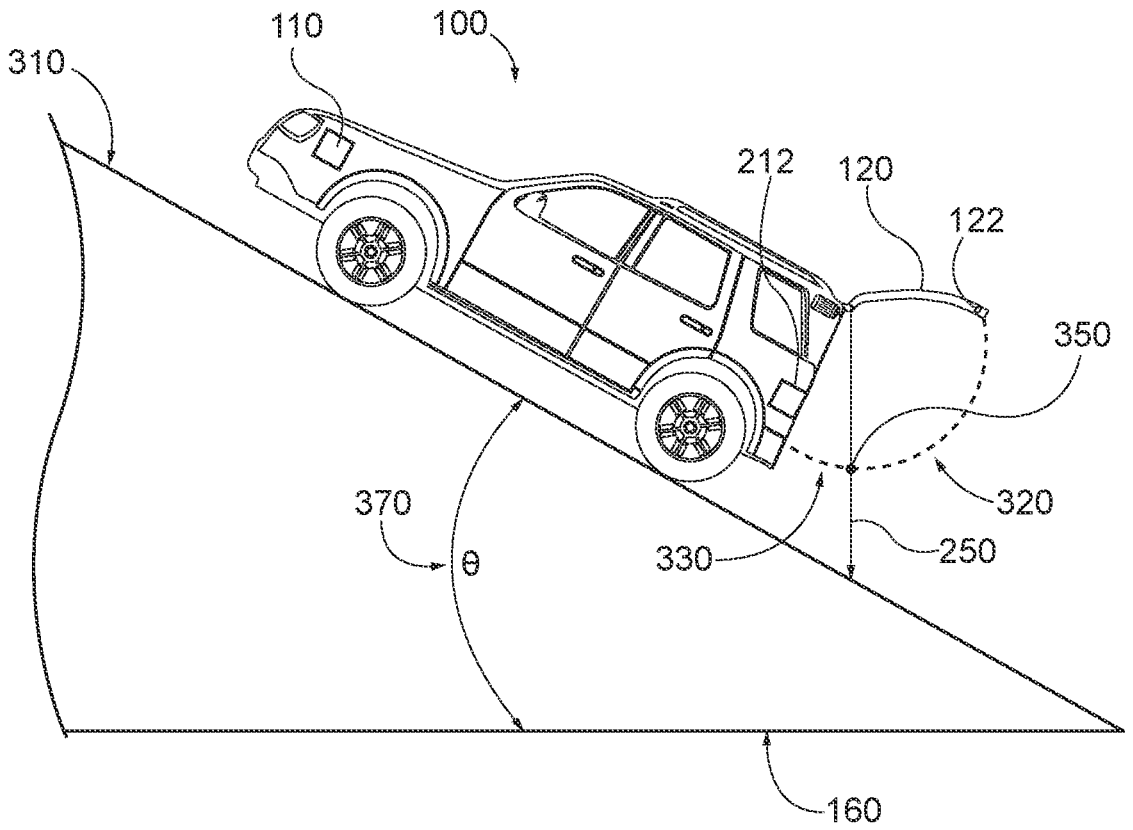
FIG. 3 is an illustration of an exemplary system for vehicle power door operation, according to one aspect.

FIG. 3 is an illustration of an exemplary system 100 for vehicle power door operation, according to one aspect. In FIG. 3, the vehicle is parked facing uphill on an incline 310. In other words, the vehicle is parked such that the first accelerometer 112 is located farther up the incline 310 than the second accelerometer 122 and the third accelerometer 212. As a result of this parking configuration, the third accelerometer 212 is located on a downhill side of the incline 310 and this orientation may be recognized by the ECU 110 based on an analysis of the first and second measurements. Further, the second accelerometer 122, during a power closing operation, may travel along a first portion 320 of the path and a second portion 330 of the path.

It will be appreciated that the first portion 320 of the path is associated with a vector component which is in the same direction as gravity 250, while the second portion 330 of the path is associated with a vector component which is in the opposite direction as gravity 250. In this regard, the ECU 110 may receive measurements (e.g., the first measurement, the second measurement, and/or the third measurement, etc.) from the first accelerometer 112, the second accelerometer 122, and/or the third accelerometer 212, respectively, and determine an orientation of the vehicle relative to the reference plane 160 based on the respective measurements. While this example is described with respect to the first accelerometer 112, the second accelerometer 122, and the third accelerometer 212, it will be appreciated that fewer (e.g., two) or more accelerometers may be implemented according to other aspects.

In any event, the ECU 110 may determine the orientation of the vehicle relative to the reference plane 160, and in this example, determine that the vehicle is facing uphill on the incline 310. Further, the second accelerometer 122 may continually provide updated second measurements throughout a power tailgate 120 closure operation from the first portion 320 of the path to the second portion 330 of the path. As previously discussed, along the first portion 320 of the path, the second accelerometer 122 may merely provide second measurements indicative of a downward component in the same direction as gravity 250. However, at a transition point 350 between the first portion 320 of the path and the second portion 330 of the path, the second accelerometer 122 may provide second, updated measurements indicative of an upward component in the opposite direction as gravity 250.

In this regard, the ECU 110 may adjust the power operation of the power tailgate 120 by the motor controller 130 based on this newly determined orientation of the power tailgate 120 and associated second accelerometer 122 (e.g., due to the change between the vertical movement component associated with the first portion 320 of the path and the second portion 330 of the path). For example, along the first portion 320 of the path, the ECU 110 may adjust the power operation of the power tailgate 120 by commanding the motor controller 130 to increase torque in a first direction (e.g., a counterclockwise direction in FIG. 3).

According to one aspect, the ECU 110 may adjust the power operation of the power tailgate 120 by the motor controller 130 based on the determined orientation of the vehicle, the angle 270 associated with the power tailgate 120 opening with respect to gravity 250, an angle 370 of the incline 310, and/or a weight associated with the power tailgate 120 structure. Along the second portion 330 of the path, the ECU 110 may adjust the power operation of the power tailgate 120 by commanding the motor controller 130 to increase torque in a second direction (e.g., a clockwise direction in FIG. 3) which is opposite of the first direction. In this way, safety may be enhanced during vehicle power door operation.

According to other aspects, the ECU 110 may calculate an angle 370 associated with the incline 310 and/or the transition point 350 between the first portion 320 of the path and the second portion 330 of the path. In this regard, if the second accelerometer 122 senses an unexpected measurement event (e.g., a vibration exceeding a threshold, a sudden change in acceleration, etc.), the ECU 110 may implement an anti-entrapment measure and adjust the power operation of the power tailgate 120 by the motor controller 130 by reversing a direction of the power operation of the power tailgate 120 or stopping operation of the power tailgate 120 or power door.

In any event, with the first accelerometer 112 mounted on the first portion of the vehicle and the second accelerometer 122 mounted to the second portion of the vehicle (e.g., different than the first portion or separate and away from the first portion), the ECU 110 may determine the position of the power tailgate 120 by comparing the first measurement (e.g., an absolute measurement indicative of the position of the vehicle body 102) and the second measurement (e.g., an absolute measurement indicative of the position of the power tailgate 120), thereby producing a relative measurement indicative of the position of the power tailgate 120 relative to the vehicle body 102 and/or trunk latch.

Figure 4:
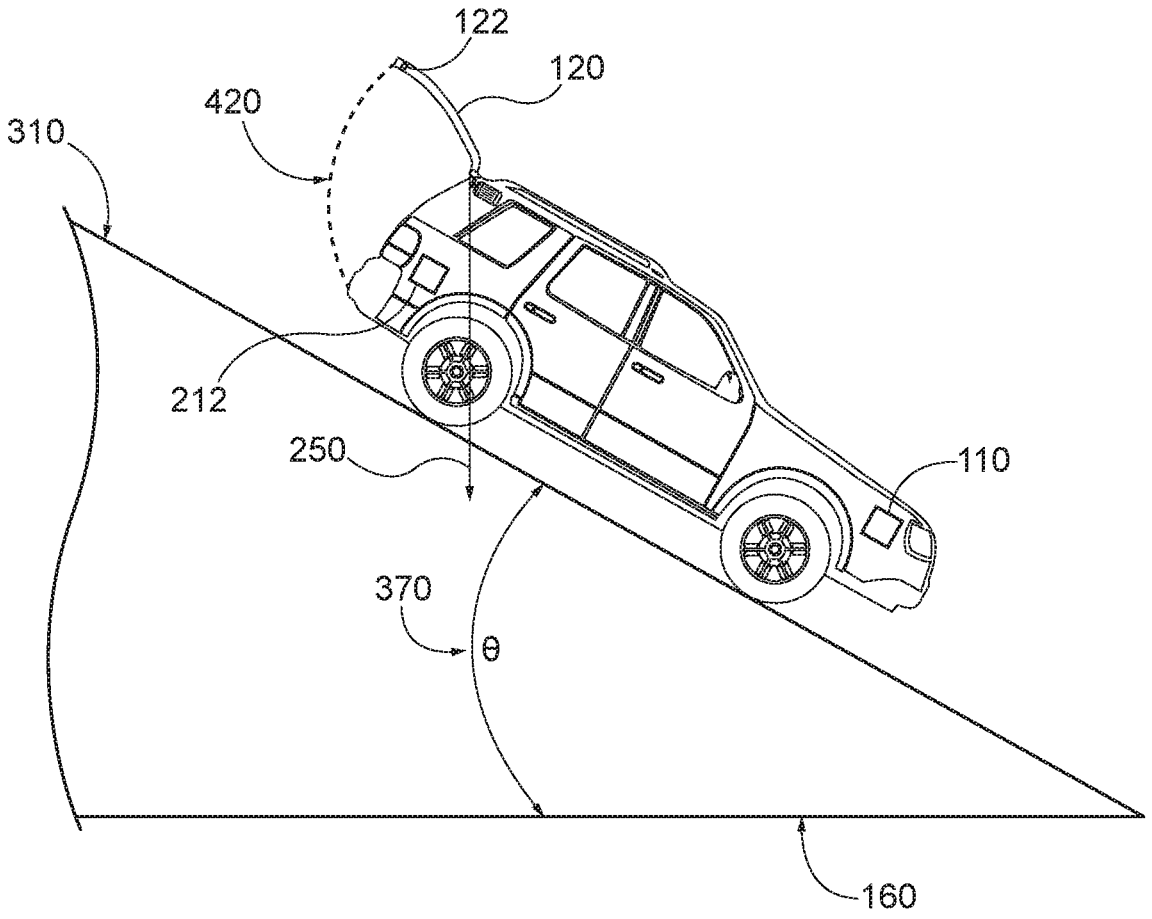
FIG. 4 is an illustration of an exemplary system for vehicle power door operation, according to one aspect.

FIG. 4 is an illustration of an exemplary system 100 for vehicle power door operation, according to one aspect. In FIG. 4, the vehicle is parked facing downhill, rather than facing uphill, and the ECU 110 may make an orientation determination accordingly based on the first and second measurements from the respective first accelerometer 112 and the second accelerometer 122. Here, during the power tailgate 120 closing operation, the second accelerometer 122 may travel along a path 420 which is associated with the downward component of gravity 250 along the entire path 420. In this regard, the ECU 110 may command the motor controller 130 to adjust the power operation of the power tailgate 120 to increase torque (in the clockwise direction in FIG. 4) based on the determined orientation of the vehicle.

Figure 5:
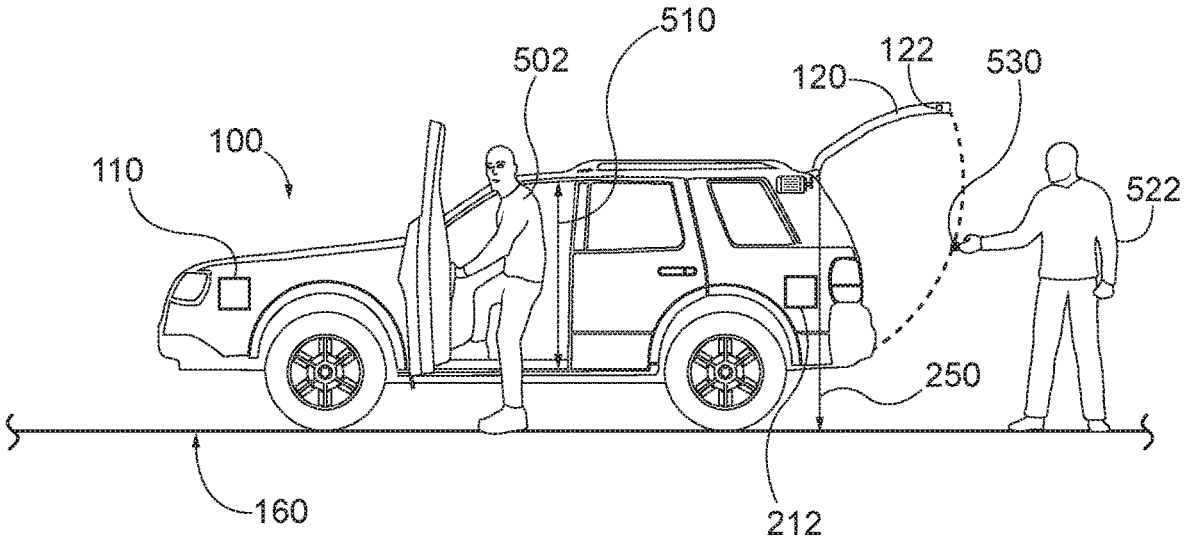
FIG. 5 is an illustration of an exemplary system for vehicle power door operation, according to one aspect.

FIG. 5 is an illustration of an exemplary system 100 for vehicle power door operation, according to one aspect. In this example, an individual 502 is getting out of the vehicle, thereby causing the vehicle, including the first accelerometer 112 and the second accelerometer 122 (and the third accelerometer 212, if used) to move 510 in a vertical direction. Because the first accelerometer 112 and the second accelerometer 122 may provide first and second measurements indicative of this vertical movement 510, the ECU 110 may adjust the power operation of the power tailgate 120 by commanding the motor controller 130 accordingly.

According to another aspect, if another individual 522 is blocking the path of the power tailgate 120, when the power tailgate 120 contacts 530 the individual at that portion of the path, the first accelerometer 112 and the second accelerometer 122 may provide first and second measurements associated with different characteristics than when movement 510 occurs (e.g., opposite polarity with respect to gravity 250) or signatures than when the individual is getting out of the vehicle (e.g., sharing the same polarity vertical component). For example, the ECU 110 may determine, from the first measurement and the second measurement, that the movement of the vehicle is primarily localized to an area near the second accelerometer 122. This may be taken as an inference that the individual 522 is blocking, at 530, the power tailgate 120 from closing. In this regard, the ECU 110 may enable anti-entrapment measures to be implemented by the motor controller 130, such as by reversing the direction of the power tailgate operation or by stopping the operation of the door or tailgate.

On the other hand, other types of movement, such as the oscillation 510 associated with the individual 502 getting out of the vehicle, may be indicative (e.g., when the first and second measurements are analyzed by the ECU 110) of movement of both the first accelerometer 112 and the second accelerometer 122 in a concurrent fashion, thereby enabling the ECU 110 to infer that no anti-entrapment measures are to be implemented, for example.

Because the first accelerometer 112 and the second accelerometer 122 are mounted at different positions, the difference in movement detected by the respective accelerometers may be measured, and movement of the vehicle as a whole may be determined, enabling movement associated with the power tailgate 120 to be isolated from the movement near the ECU accelerometer 112, thereby enabling the ECU 110 to implement entrapment mitigation operations of the power tailgate 120 (e.g., by controlling the motor controller 130) more efficiently and/or accurately (e.g., mitigating false positives and more accurately determining entrapment scenarios).

Figure 6:
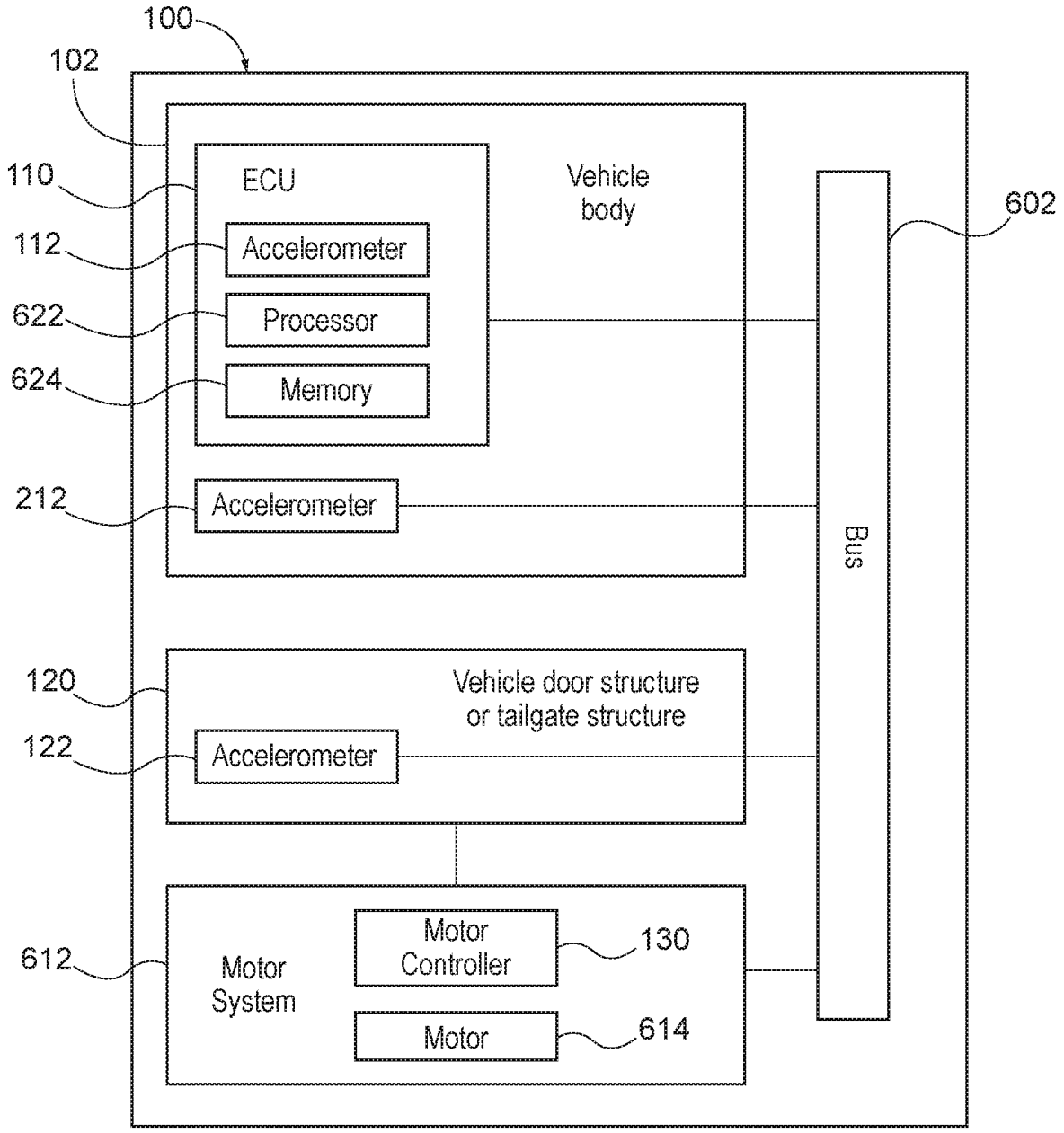
FIG. 6 is an illustration of an example component diagram of the system for vehicle power door operation, according to one aspect.

FIG. 6 is an illustration of an example component diagram of the system 100 for vehicle power door operation, according to one aspect. The system 100 for vehicle power door operation may include the vehicle having the vehicle body 102, the ECU 110, an accelerometer (e.g., the first accelerometer 112 of FIG. 1) integral to the ECU 110, a processor 622, and a memory 624. The processor 622 and memory 624 may perform the determinations or calculations described herein using the measurements received from respective accelerometers. The memory 624 may store control maps or control tables which may include instructions for the motor controller 130 for power operations of the power door or power tailgate 120. The ECU 110 may modify or adjust the implementation of these control maps or control tables based on the aforementioned features related to the first measurement taken by the first accelerometer 112 and the second measurement taken by the second accelerometer 122.

Additionally, other accelerometers (e.g., the third accelerometer 212 of FIG. 2) may be mounted to other portions of the vehicle body 102. The system 100 may include a vehicle door structure which may be the power tailgate 120, and include the second accelerometer 122. A motor system 612 may include the motor controller 130 driving a motor 614, which enables power operations of the power tailgate 120 or vehicle door structure by moving the power door or power tailgate 120. The system 100 may include a bus 602 which operably connects the first accelerometer 112, the second accelerometer 122, the motor controller 130, and the ECU 110.

Figure 7:
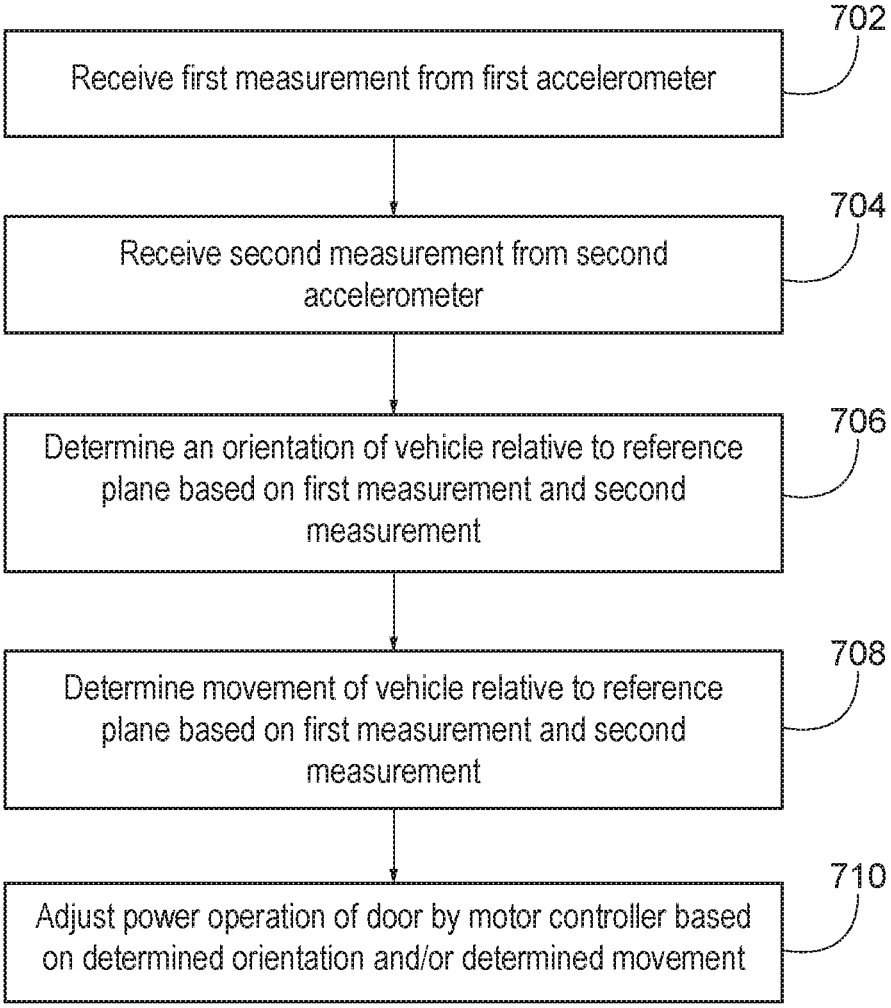
FIG. 7 is an illustration of an example flow diagram of a method for vehicle power door operation, according to one aspect.

FIG. 7 is an illustration of an example flow diagram of a method 700 for vehicle power door operation, according to one aspect. The method 700 may include receiving a first measurement from a first accelerometer 112 mounted to a first portion of a vehicle at 702, receiving a second measurement from a second accelerometer 122 mounted to a second portion of the vehicle at 704, determining an orientation of the vehicle relative to a reference plane 160 based on the first and second measurements at 706, determining a movement of the vehicle relative to the reference plane 160 based on the first and second measurements at 708, and adjusting a power operation of a power door, power trunk, or power tailgate 120 via a motor controller 130 based on the determined orientation and/or the determined movement at 710.

According to one aspect, the determined orientation may include an orientation of the vehicle (e.g., facing uphill or facing downhill), an angle 370 of the incline 310 (e.g., hill), an angle 270 of a door relative to a reference plane 160 or another reference plane 250 (e.g., gravity), a weight associated with the power door or power tailgate 120, etc. Further, the determined movement may include a vibration of the vehicle localized near the power door or power tailgate 120, an oscillation of the vehicle as a whole, etc. In any event, the power operation may be adjusted accordingly and in a manner to improve safety and/or implement anti-entrapment (e.g., by commanding the motor controller 130 to reverse a direction of operation, slow down, speed up, increase torque in a first direction, increase torque in a second direction, decrease torque, cease or stop operation, etc.).

Thus, as seen from the above description, the systems and techniques described herein provide for many benefits and are advantageous in several different ways. For example, the systems and methods for vehicle power door operation may account for more than merely the position and the speed of the power door relative to the position and the speed of the vehicle body 102 by accounting for the impact associated with gravity 250 and the orientation of the vehicle with respect to the incline 310 (e.g., determining whether the vehicle is parked on an up-slope or on a down-slope).

Additionally, if power is lost and subsequently restored, the use of the accelerometers enables the system 100 to continue operation without any need for calibration because accelerometers do not need to be reset to a home position to be utilized. In this way, the two or more accelerometers mounted at different locations of the vehicle enable the system 100, in real-time, to compensate for movement and/or orientation of the vehicle and/or an incline 310 during operation of the power door or the power tailgate 120.

Still yet another benefit of the systems and methods for vehicle power door operation is the determination of movement of different portions of the vehicle relative to one another and to the environment or the reference plane 160. For example, with reference to FIG. 5 described above, it can be seen that the vehicle body 102 of the vehicle and the power tailgate 120 of the vehicle move generally in unison. However, in other scenarios, such as where a child is jumping in the backseat of the vehicle, the vehicle body 102 of the vehicle and the power tailgate 120 of the vehicle may not necessarily move in concert with one another. As yet another example, if a passenger sits in the front passenger seat while the power tailgate 120 is closing, the system 100 may receive inputs from both the first accelerometer 112 and the second accelerometer 122, and the ECU 110 may control the motor controller 130 of the power tailgate 120 accordingly.

Figure 8:
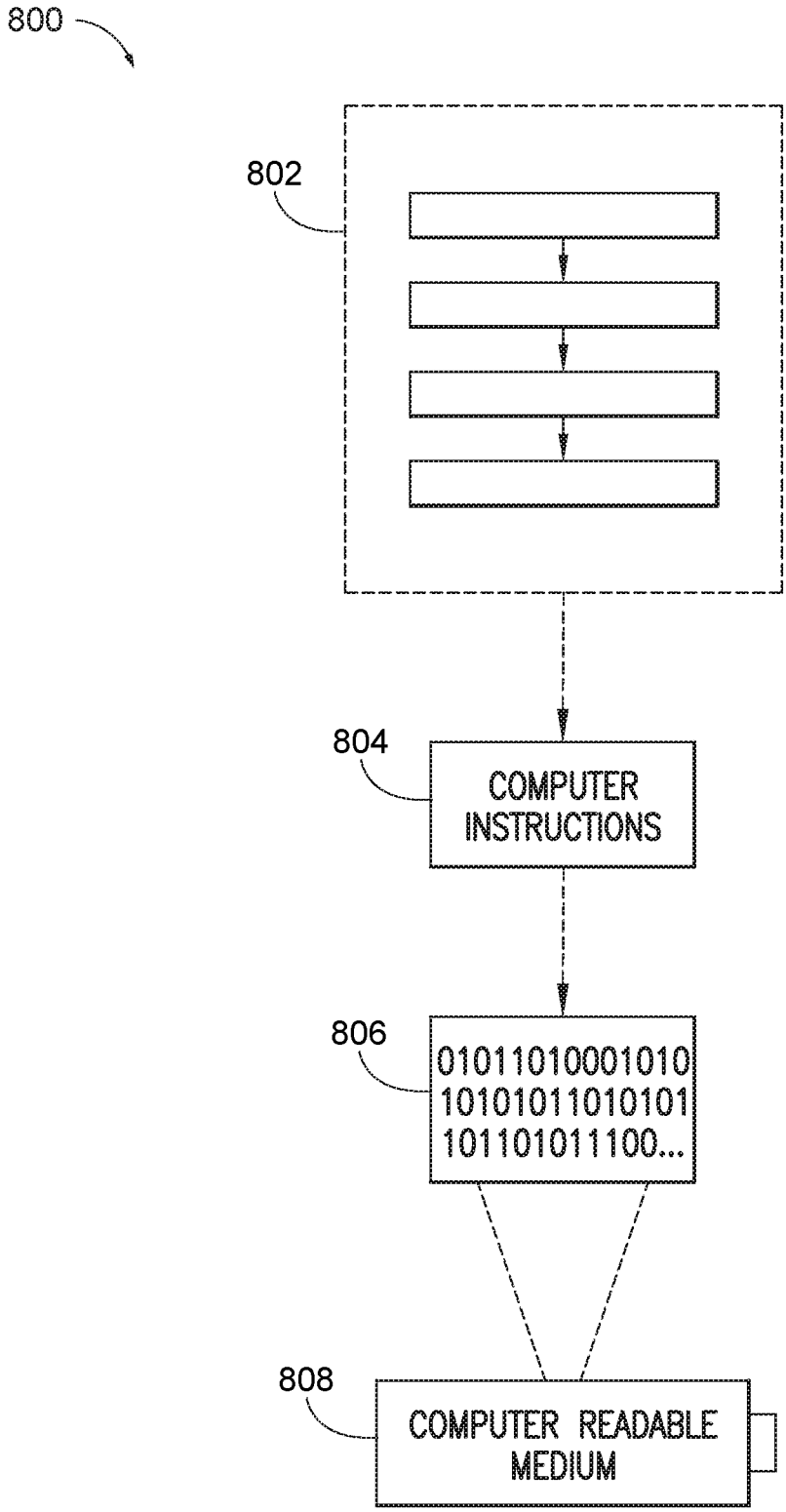
FIG. 8 is an illustration of an example computer-readable medium or computer-readable device including processor-executable instructions configured to embody one or more of the provisions set forth herein, according to one aspect.

Still another aspect involves a computer-readable medium including processor-executable instructions configured to implement one aspect of the techniques presented herein. An embodiment of a computer-readable medium or a computer-readable device devised in these ways is illustrated in FIG. 8, wherein an implementation 800 includes a computer-readable medium 808, such as a CD-R, DVD-R, flash drive, a platter of a hard disk drive, etc., on which is encoded computer-readable data 806. This encoded computer-readable data 806, such as binary data including a plurality of zero's and one's as shown in 806, in turn includes a set of processor-executable computer instructions 804 configured to operate according to one or more of the principles set forth herein. In one such embodiment 800, the processor-executable computer instructions 804 may be configured to perform a method 802, such as the method 700 of FIG. 7. In another aspect, the processor-executable computer instructions 804 may be configured to implement a system, such as the system 100 of FIG. 6. Many such computer-readable media may be devised by those of ordinary skill in the art that are configured to operate in accordance with the techniques presented herein.

As used in this application, the terms "component", "module," "system", "interface", and the like are generally intended to refer to a computer-related entity, either hardware, a combination of hardware and software, software, or software in execution. For example, a component may be, but is not limited to being, a process running on a processor, a processor, an object, an executable, a thread of execution, a program, or a computer. By way of illustration, both an application running on a controller and the controller may be a component. One or more components residing within a process or thread of execution and a component may be localized on one computer or distributed between two or more computers.

Further, the claimed subject matter is implemented as a method, apparatus, or article of manufacture using standard programming or engineering techniques to produce software, firmware, hardware, or any combination thereof to control a computer to implement the disclosed subject matter. The term "article of manufacture" as used herein is intended to encompass a computer program accessible from any computer-readable device, carrier, or media. Of course, many modifications may be made to this configuration without departing from the scope or spirit of the claimed subject matter.

Figure 9:
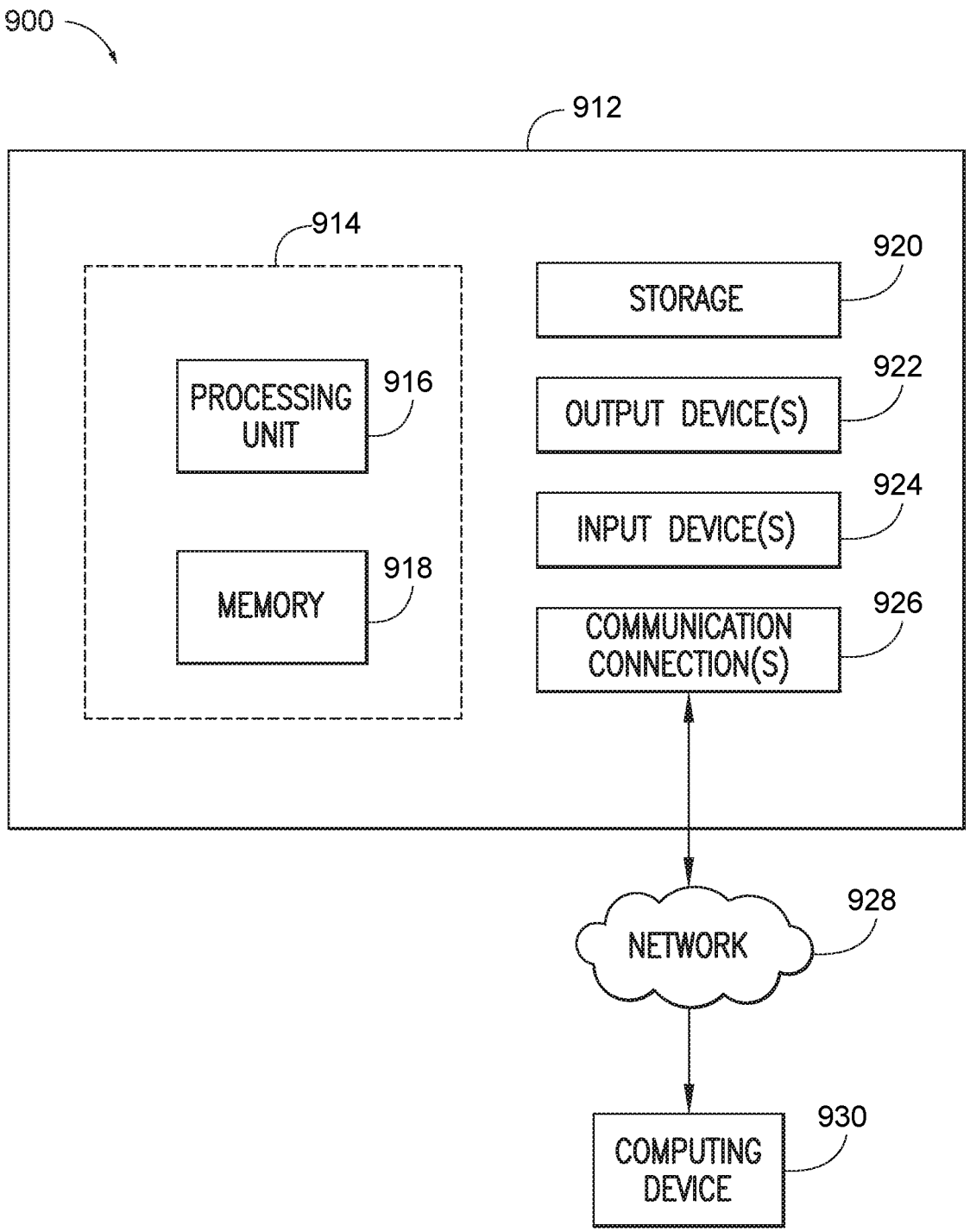
FIG. 9 is an illustration of an example computing environment where one or more of the provisions set forth herein are implemented, according to one aspect.

FIG. 9 and the following discussion provide a description of a suitable computing environment to implement aspects of one or more of the provisions set forth herein. The operating environment of FIG. 9 is merely one example of a suitable operating environment and is not intended to suggest any limitation as to the scope of use or functionality of the operating environment. Example computing devices include, but are not limited to, personal computers, server computers, hand-held or laptop devices, mobile devices, such as mobile phones, Personal Digital Assistants (PDAs), media players, and the like, multiprocessor systems, consumer electronics, mini computers, mainframe computers, distributed computing environments that include any of the above systems or devices, etc.

Generally, embodiments or aspects are described in the general context of "computer readable instructions" being executed by one or more computing devices. Computer readable instructions may be distributed via computer readable media as will be discussed below. Computer readable instructions may be implemented as program modules, such as functions, objects, Application Programming Interfaces (APIs), data structures, and the like, that perform one or more tasks or implement one or more abstract data types. Typically, the functionality of the computer readable instructions are combined or distributed as desired in various environments.

FIG. 9 illustrates a system 900 including a computing device 912 configured to implement one aspect provided herein. In one configuration, computing device 912 includes at least one processing unit 916 and memory 918. Depending on the exact configuration and type of computing device, memory 918 may be volatile, such as RAM, non-volatile, such as ROM, flash memory, etc., or a combination of the two. This configuration is illustrated in FIG. 9 by dashed line 914.

In other aspects, computing device 912 includes additional features or functionality. For example, computing device 912 may include additional storage such as removable storage or non-removable storage, including, but not limited to, magnetic storage, optical storage, etc. Such additional storage is illustrated in FIG. 9 by storage 920. In one aspect, computer readable instructions to implement one aspect provided herein are in storage 920. Storage 920 may store other computer readable instructions to implement an operating system, an application program, etc. Computer readable instructions may be loaded in memory 918 for execution by processing unit 916, for example.

The term "computer readable media" as used herein includes computer storage media. Computer storage media includes volatile and nonvolatile, removable and non-removable media implemented in any method or technology for storage of information such as computer readable instructions or other data. Memory 918 and storage 920 are examples of computer storage media. Computer storage media includes, but is not limited to, RAM, ROM, EEPROM, flash memory or other memory technology, CD-ROM, Digital Versatile Disks (DVDs) or other optical storage, magnetic cassettes, magnetic tape, magnetic disk storage or other magnetic storage devices, or any other medium which may be used to store the desired information and which may be accessed by computing device 912. Any such computer storage media is part of computing device 912.

The term "computer readable media" includes communication media. Communication media typically embodies computer readable instructions or other data in a "modulated data signal" such as a carrier wave or other transport mechanism and includes any information delivery media. The term "modulated data signal" includes a signal that has one or more of its characteristics set or changed in such a manner as to encode information in the signal.

Computing device 912 includes input device(s) 924 such as keyboard, mouse, pen, voice input device, touch input device, infrared cameras, video input devices, or any other input device. Output device(s) 922 such as one or more displays, speakers, printers, or any other output device may be included with the computing device 912. Input device(s) 924 and output device(s) 922 may be connected to the computing device 912 via a wired connection, wireless connection, or any combination thereof. In one aspect, an input device or an output device from another computing device may be used as input device(s) 924 or output device(s) 922 for computing device 912. The computing device 912 may include communication connection(s) 926 to facilitate communications with one or more other devices 930, such as through network 928, for example.

Although the subject matter has been described in language specific to structural features or methodological acts, it is to be understood that the subject matter of the appended claims is not necessarily limited to the specific features or acts described above. Rather, the specific features and acts described above are disclosed as example embodiments.

Various operations of embodiments are provided herein. The order in which one or more or all of the operations are described should not be construed as to imply that these operations are necessarily order dependent. Alternative ordering will be appreciated based on this description. Further, not all operations may necessarily be present in each embodiment provided herein.

As used in this application, "or" is intended to mean an inclusive "or" rather than an exclusive "or". Further, an inclusive "or" may include any combination thereof (e.g., A, B, or any combination thereof). In addition, "a" and "an" as used in this application are generally construed to mean "one or more" unless specified otherwise or clear from context to be directed to a singular form. Additionally, at least one of A and B and/or the like generally means A or B or both A and B. Further, to the extent that "includes", "having", "has", "with", or variants thereof are used in either the detailed description or the claims, such terms are intended to be inclusive in a manner similar to the term "comprising".

Further, unless specified otherwise, "first", "second", or the like are not intended to imply a temporal aspect, a spatial aspect, an ordering, etc. Rather, such terms are merely used as identifiers, names, etc. for features, elements, items, etc. For example, a first channel and a second channel generally correspond to channel A and channel B or two different or two identical channels or the same channel. Additionally, "comprising", "comprises", "including", "includes", or the like generally means comprising or including, but not limited to.

It will be appreciated that various of the above-disclosed and other features and functions, or alternatives or varieties thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A system for vehicle power door operation, comprising:
- a first accelerometer mounted to a first portion of a vehicle;
- a second accelerometer mounted to a second portion of the vehicle;
- a motor controller controlling a power operation of a door of the vehicle; and
- an electronic control unit (ECU):
- receiving a first measurement from the first accelerometer;
- receiving a second measurement from the second accelerometer;
- determining an overall orientation of a longitudinal axis of the vehicle relative to a reference plane based on both the first measurement and the second measurement, wherein the longitudinal axis extends from a front end of the vehicle to a rear end of the vehicle;
- adjusting the power operation of the power door by the motor controller based on the determined orientation.

2. The system for vehicle power door operation of claim 1, wherein the first measurement or the second measurement include a proper acceleration measurement or a coordinate acceleration measurement.

3. The system for vehicle power door operation of claim 1, wherein the first accelerometer is mounted to a vehicle body of the vehicle, the second accelerometer is mounted to a power door of the vehicle, and the motor controller controls a power operation of the power door of the vehicle.

4. The system for vehicle power door operation of claim 1, wherein the first accelerometer is integrated with the ECU.

5. The system for vehicle power door operation of claim 1, wherein the first accelerometer and the second accelerometer are 2-axis or 3-axis accelerometers.

6. The system for vehicle power door operation of claim 1, wherein the adjusting the power operation of the power door by the motor controller includes reversing a direction of the power operation of the power door or stopping operation of the power door.

7. The system for vehicle power door operation of claim 1, comprising a bus operably connecting the first accelerometer, the second accelerometer, the motor controller, and the ECU.

8. The system for vehicle power door operation of claim 1, wherein the ECU determines any movement of the vehicle relative to the reference plane based on the first measurement and the second measurement and adjusts the power operation of the power door by the motor controller based on the determined movement.

9. A system for vehicle power door operation, comprising:
- a first accelerometer mounted to a first portion of a vehicle;
- a second accelerometer mounted to a second portion of the vehicle;
- a motor controller controlling a power operation of a door of the vehicle; and
- an electronic control unit (ECU):
- receiving a first measurement from the first accelerometer;
- receiving a second measurement from the second accelerometer;
- determining any movement of an overall orientation of a longitudinal axis of the vehicle relative to a reference plane based on both the first measurement and the second measurement, wherein the longitudinal axis extends from a front end of the vehicle to a rear end of the vehicle; and
- adjusting the power operation of the power door by the motor controller based on the determined movement.

10. The system for vehicle power door operation of claim 9, wherein the first measurement or the second measurement include a proper acceleration measurement or a coordinate acceleration measurement.

11. The system for vehicle power door operation of claim 9, wherein the first accelerometer is mounted to a vehicle body of the vehicle, the second accelerometer is mounted to a power door of the vehicle, and the motor controller controls a power operation of the power door of the vehicle.

12. The system for vehicle power door operation of claim 9, wherein the first accelerometer is integrated with the ECU.

13. The system for vehicle power door operation of claim 9, wherein the first accelerometer and the second accelerometer are 2-axis or 3-axis accelerometers.

14. The system for vehicle power door operation of claim 9, wherein the adjusting the power operation of the power door by the motor controller includes reversing a direction of the power operation of the power door or stopping operation of the power door.

15. The system for vehicle power door operation of claim 9, comprising a bus operably connecting the first accelerometer, the second accelerometer, the motor controller, and the ECU.

16. The system for vehicle power door operation of claim 9, wherein the ECU determines the orientation of the vehicle relative to the reference plane based on the first measurement and the second measurement and adjusts the power operation of the power door by the motor controller based on the determined orientation.

17. A system for vehicle power door operation, comprising:

a first accelerometer mounted to a first portion of a vehicle;

a second accelerometer mounted to a second portion of the vehicle;

a motor controller controlling a power operation of a door of the vehicle; and an electronic control unit (ECU):

receiving a first measurement from the first accelerometer;

receiving a second measurement from the second accelerometer;

determining an overall orientation of a longitudinal axis of the vehicle relative to a reference plane based on both the first measurement and the second measurement, wherein the longitudinal axis extends from a front end of the vehicle to a rear end of the vehicle;

determining any movement of the vehicle relative to the reference plane based on the first measurement and the second measurement; and adjusting the power operation of the power door by the motor controller based on the determined orientation and the determined movement.

18. The system for vehicle power door operation of claim 17, wherein the first measurement or the second measurement include a proper acceleration measurement or a coordinate acceleration measurement.

19. The system for vehicle power door operation of claim 17, wherein the first accelerometer is mounted to a vehicle body of the vehicle, the second accelerometer is mounted to a power door of the vehicle, and the motor controller controls a power operation of the power door of the vehicle.

20. The system for vehicle power door operation of claim 17, wherein the first accelerometer and the second accelerometer are 2-axis or 3-axis accelerometers.

* * * * *